United States Patent [19]

Das et al.

[11] Patent Number: 4,908,181

[45] Date of Patent: Mar. 13, 1990

[54] INGOT CAST MAGNESIUM ALLOYS WITH IMPROVED CORROSION RESISTANCE

[75] Inventors: Santosh K. Das, Randolph; Chin-Fong Chang, Morris Plains, both of N.J.

[73] Assignee: Allied-Signal Inc., Morris Township, Morris County, N.J.

[21] Appl. No.: 164,759

[22] Filed: Mar. 7, 1988

[51] Int. Cl.[4] ..... C22C 23/02

[52] U.S. Cl. ..... 420/405; 420/408; 420/409

[58] Field of Search ..... 420/405, 407, 408, 409, 420/410, 411, 412; 148/406, 420

[56] References Cited

U.S. PATENT DOCUMENTS

| | | | |
|---|---|---|---|
| 1,886,251 | 11/1932 | Gann | 420/412 |
| 1,905,445 | 4/1933 | de Ridder et al. | 420/409 |
| 2,420,293 | 5/1947 | Beck et al. | 420/405 |
| 4,675,157 | 6/1987 | Das et al. | 420/405 |
| 4,765,954 | 8/1988 | Das et al. | 420/405 |

FOREIGN PATENT DOCUMENTS

| | | | |
|---|---|---|---|
| 136096 | 12/1929 | Switzerland | 420/405 |
| 533719 | 2/1941 | United Kingdom | 420/405 |
| 693478 | 7/1953 | United Kingdom | 420/405 |

OTHER PUBLICATIONS

Industry's Lightest Structural Metal, Dow Chemical Company, Midland, Mich., pp. 2–15.

J. D. Hanawalt, C. E. Nelson, J. A. Peloubet, "Corrosion Studies of Magnesium and its Alloys", Trans AIME, 147, (1942), pp. 273–299.

J. E. Hillis, K. N. Reichek, K. J. Clark, "Controlling the Salt Water Corrosion Performance of Magnesium AZ91 Alloy in High and Low Pressure Cast Form", Recent Advances In Magnesium Technology, American Foundrymen's Society, Inc. (1986), pp. 87–106.

*Primary Examiner*—Robert Mc Dowell

*Attorney, Agent, or Firm*—Ernest D. Buff; Gerhard H. Fuchs

[57] ABSTRACT

A magnesium alloy consists essentially of the formula $Mg_{bal}Al_aZn_bX_c$, wherein X is at least one element selected from the group consisting of manganese, cerium, neodymium, praseodymium, and yttrium, "a" ranges from about 0 to 15 atom percent, "b" ranges from about 0 to 4 atom percent, and "c" ranges from about 0.2 to 3 atom percent, the balance being magnesium and incidental impurities, with the proviso that the sum of aluminum and zinc present ranges from about 2 to 15 atom percent. Second phase particles contained by the alloy are less susceptible to corrosion attack. Articles produced from the alloy have superior corrosion resistance and mechanical properties comparable to those made from commercial magnesium alloys. Such articles are suitable for application as structural members in helicopters, air frames, such as gear box housings, where good corrosion resistance in combination with low density and good strength are required.

6 Claims, 10 Drawing Sheets

INGOT CAST MAGNESIUM ALLOYS WITH IMPROVED CORROSION RESISTANCE

FIELD OF INVENTION

This invention relates to magnesium based alloys, for sand, chill and permanent mold castings, with corrosion resistance superior to commercially available magnesium casting alloys.

DESCRIPTION OF THE PRIOR ART

Magnesium alloys are considered attractive candidates for structural use in aerospace and automotive industry because of their light weight, high strength to weight ratio, and high specific stiffness at both room and elevated temperatures. Although magnesium has reasonable corrosion properties under regular atmospheric conditions, it is susceptible to attack by chloride containing environments. Furthermore, the high chemical reactivity of magnesium, as represented by its extreme position in the electrochemical series and its inability to form a protective, self-healing, passive film in corrosive environments, makes magnesium alloys vulnerable to galvanic attack when coupled with more noble metals. In addition to the galvanic coupling between the structural members, localized corrosion may occur due to inhomogeneities within the magnesium alloy that act as electrodes for galvanic corrosion. This poor corrosion resistance of magnesium alloys has been a serious limitation, preventing wide scale use of magnesium alloys. The effect of alloy content on the corrosion resistance of magnesium alloys has been studied in magnesium binary alloys. It is well documented [J. D. Hanawalt, C. E. Nelson, and J. A. Peloubet, "Corrosion Studies of Magnesium and its Alloys," Trans AIME, 147, (1942), pp. 273–99] that heavy metal impurities such as Fe, Ni, Co, and Cu have a profound accelerating effect on corrosion rate in saline environment. Recently attempts have been made to improve the corrosion resistance of magnesium alloys by reducing the impurity levels and increasing the tolerance limits for heavy metal impurities by additions of zinc and manganese, and a high purity alloy such as AZ91HP has been introduced in the market place, [J. E. Hillis, K. N. Reichek, K. J. Clark," Controlling the Salt Water Corrosion Performance of Magnesium AZ91 Alloy in High and Low Pressure Cast Form", Recent Advances in Magnesium Technology, American Foundrymen's Society, Inc., (1986), pp. 87–106]. In the studies reported to date, efforts have been concentrated on impurity control and minor element additions. No effect has been reported which delineates the effects of alloy chemistry on the corrosion resistance of ingot cast magnesium alloys. There remains a need in the art for ingot cast magnesium alloys having improved corrosion resistance.

SUMMARY OF THE INVENTION

The present invention provides a magnesium based alloy, for sand, chill, and permanent mold casting, with corrosion resistance superior to commercially available magnesium casting alloys. Generally stated, the alloy has a composition consisting essentially of the formula $Mg_{bal}Al_aZn_bX_c$, wherein X is at least one element selected from the group consisting of manganese, cerium, neodymium, praseodymium, and yttrium "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent.

The invention also provides a method wherein the magnesium alloys of present invention are subjected to sand, chill, and permanent mold castings. That process further comprises the provision of a means to protect the melt from burning, and excessive oxidation. Said protection is provided by a shrouding apparatus containing a protective gas such as a mixture of air or $CO_2$ and $SF_6$, a reducing gas such as CO or an inert gas, around the casting nozzle.

The alloying elements manganese, cerium, neodymium, and praseodymium, upon casting, form a dispersion of intermetallic phases such as $Al_3Mn$, $Al_2Nd$, depending on the alloy composition. The alloy containing yttrium forms a coarse intermetallic phase $Al_2Y$. These intermetallic phases are less susceptible to corrosion attack in saline environment that ingot cast magnesium alloys wherein these phases are absent.

The castability of these alloys is good, and finished castings exhibit good corrosion resistance [i.e. corrosion rate of less than 50 mils per year when immersed in a 3.5% NaCl aqueous solution (ASTM-G31) at 25° C. for 96 hours, or less than 10% weight loss after exposure in 5% salt spray (fog) testing (ASTM-B117) for 20 days.] Mechanical properties of the finished castings are comparable to those of conventional magnesium alloys. Articles produced from the finished castings are suitable for applications as structural members in helicopters and air frames, such as gearbox housings, where good corrosion resistance in combination with light weight and good strength are desirable.

BRIEF DESCRIPTION OF THE DRAWINGS

The invention will be more fully understood and further advantages will become apparent when reference is made to the following detailed description and the accompanying drawings, in which:

FIG. 1(*b*) is an optical micrograph of chill cast $Mg_{91.9}Al_{5.1}Zn_2Nd_1$ alloy;

DESCRIPTION OF THE PREFERRED EMBODIMENTS

In accordance with the present invention, nominally pure magnesium is alloyed with about 0 to 15 atom percent aluminum, about 0 to 4 atom percent zinc, about 0.2 to 3 atom percent of at least one element selected from the group consisting of manganese, cerium, neodymium, praseodymium, yttrium and the balance being magnesium and incidental impurities, with the proviso that the sum of aluminum and zinc present ranges from about 2 to 15 atom percent. The alloys are melted in a protective environment; and cast into a $CO_2$ sand, or water cooled copper mold. When aluminum is alloyed without addition of zinc, the minimum aluminum content is preferably 6 atom percent.

Figure 1:
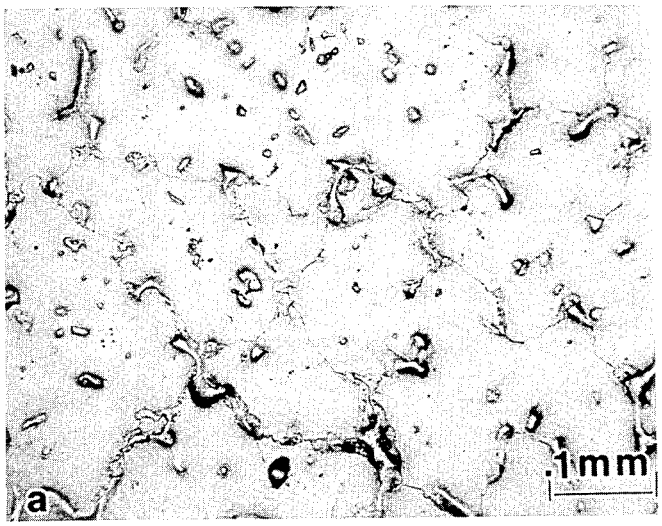
FIG. 1(*a*) is an optical micrograph of sand cast $Mg_{90}Al_{6.5}Zn_{2.1}Nd_{1.4}$ alloy.
Figure 1:
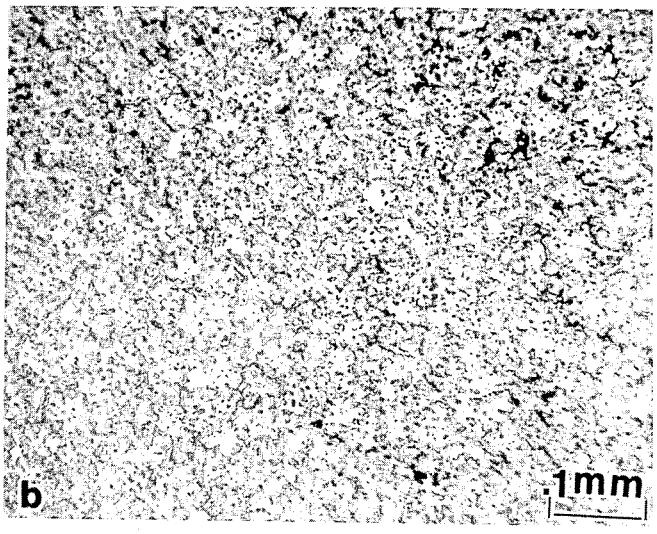
Figure 2:
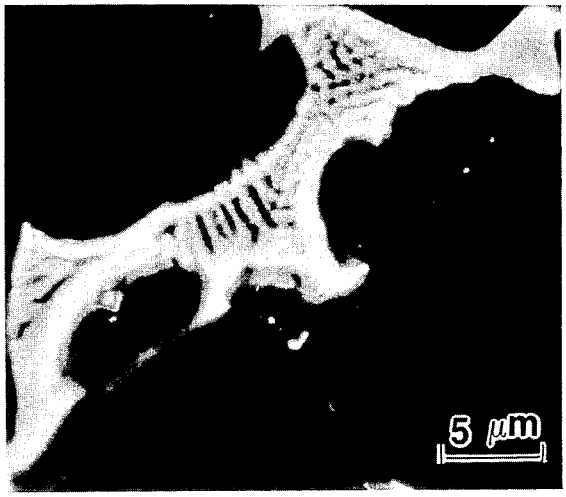
FIG. 2 is a scanning electron micrograph of chill cast $Mg_{91.9}Al_{5.1}Zn_2Nd_1$ alloy in the as-cast condition, illustrating the Mg-Al-Zn eutectic structure.
Figure 3:
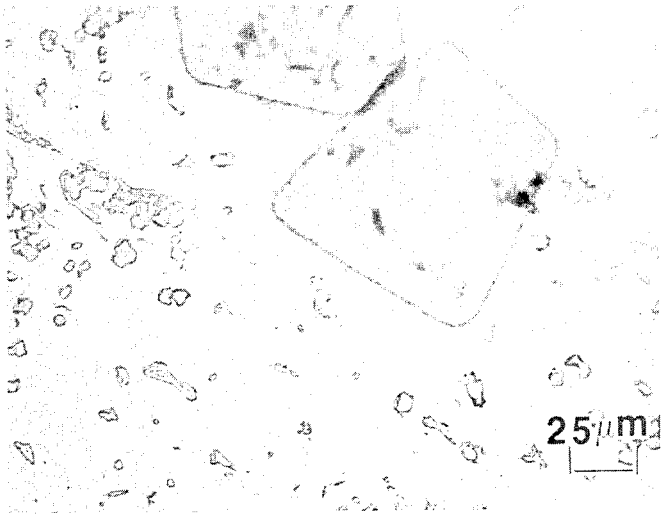
FIG. 3 is an optical micrograph of chill cast $Mg_{91.4}Al_{5.1}Zn_{1.9}Y_{1.6}$ alloy.

FIG. 1(*a*) shows coarse equiaxed grains (0.1–0.3 mm) with fine second phase particles (0.005–0.01 mm) distributed throughout the sand cast $Mg_{90}Al_{6.5}Zn_{2.1}Nd_{1.4}$ alloy. In chill cast $Mg_{91.9}Al_{5.1}Zn_2Nd_1$ alloy the grain size is refined to 0.002 mm, as shown in FIG. 1(*b*). There is Mg-Al-ZN eutectic phase present on the grain boundary, FIG. 2. The second phase particles within the grains have been identified as $Al_2Nd$ by X-ray diffraction. The $Mg_{91.4}Zn_{1.9}Al_{5.1}Y_{1.6}$ alloy exhibits a similar grain structure with coarse second phase particles in the as cast condition, FIG. 3. The second phase particles, identified as $Al_2Y$ by X-ray diffraction, formed during casting. These second phase particles are less susceptible to corrosion attack in saline environment.

The alloys of the present invention have good castability, and are suitable for sand, chill and permanent mold casting. The finished articles have mechanical strength comparable to commercial magnesium alloys either in as cast (F) condition or in the solution treated and aged (T6) condition. The corrosion resistance of the articles is superior to those made from commercial magnesium alloy [corrosion rate of less than 50 mils per year when immersed in a 3.5% NaCl aqueous solution (ASTM-G31) at 25° C. for 96 hours, or weight loss of less than 10% after exposure in 5% salt spray (fog) testing (ASTM-B117) for 20 days]. The articles also exhibit better pitting corrosion resistance in saline environment than those of commercial magnesium alloys. The articles are suitable for applications as structural members in helicopters and, air frames, such as gearbox housings, where good corrosion resistance in combination with light weight and good strength are desirable.

The following examples are presented in order to provide a more complete understanding of the invention. The specific techniques, conditions, material and reported data set forth to illustrate the invention are exemplary and should not be construed as limiting the scope of the invention.

EXAMPLE I

A laboratory immersion corrosion testing using a solution of 3.5% sodium chloride in water at 25° C. was conducted to compare the corrosion resistance of magnesium alloys relative to each other. The test conducted was the same as that recommended by ASTM standard G31-72. Samples were cut to a size of about 5.0 cm×5.0 cm×0.5 cm, polished on a 600 grit sand paper and degreased by rinsing in acetone. The mass of the sample was weighed to an accuracy of 0.0001 g. The dimensions of each sample were measured to 0.01 cm and the total surface area of each specimen was calculated.

After 96 hours immersion, the specimens were taken out, rinsed with water and dried. The corrosion product was removed by sequentially dipping the specimems in 200 gms/liter $CrO_3$ and 5 gms/liter $AgNO_3$, for 2 minutes at 80±5° C., and rinsing the specimens in distilled water. Acetone was used to degreased the specimen before weight measurement. The mass loss due to exposure and the average corrosion rate were calculated. Table I compares the corrosion rate for an alloy of the present invention with two commercial alloys AZ91HP and WE54. The corrosion rate of the alloy $Mg_{89.1}Al_{7.8}Zn_{2.2}Nd_{0.9}$ of the present invention is less than that of either of the commercial alloys. The good corrosion resistance of the alloy in the present invention is due to alloy chemistry which forms magnesium solid solution phase with electrochemical potential close to magnesium and aluminum-manganese (rare earth) intermetallic second phase particles inert to corrosion attack in saline environment.

TABLE I

Room Temperature Corrosion Behavior of Sand and Chill Cast Mg—Al—Zn—X Alloys (Immersion Testing in 3.5% NaCl Solution for 96 hrs.)

| No. | Nominal Composition | Cast | % Weight Loss | Corrosion rate (mpy) |
|---|---|---|---|---|
| 1 | $Mg_{87.9}Al_{7.1}Zn_{1.8}Y_{3.2}$ | sand | 0.34 | 33 |
| 2 | $Mg_{89.1}Al_{7.8}Zn_{2.2}Nd_{0.9}$ | chill | 0.17 | 18 |
| | Alloys Outside The Scope Of The Invention | | | |
| | Commercial Alloy AZ91HP | | | |
| 3 | $Mg_{91.7}Al_{8.0}Zn_{0.2}Mn_{0.1}$ | sand | 0.78 | 75 |
| | Commercial Alloy WE54 (Wt. %) | | | |
| 4 | $Mg_{89.2}Nd_{1.7}Y_{5.2}RE_{3.5}Zr_{0.4}$ | sand | 0.67 | 63 |

Figure 4:
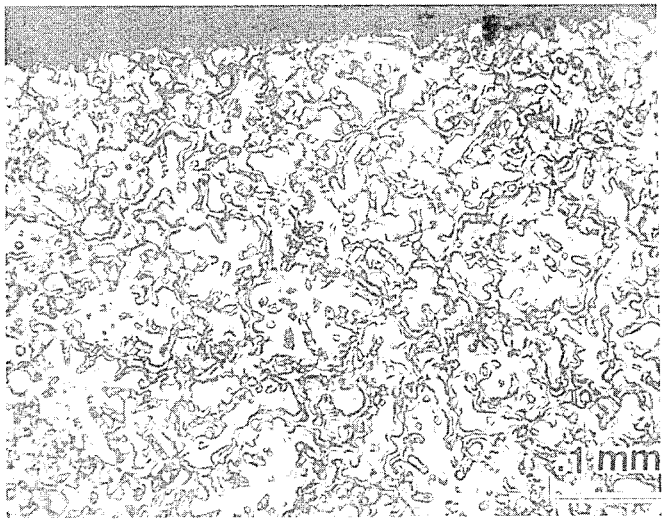
FIG. 4 is an optical micrograph of chill cast $Mg_{89.1}Al_{7.8}Zn_{2.2}Nd_{0.9}$ alloy after immersion testing in 3.5% NaCl solution for 96 hours, illustrating the good pitting corrosion resistance of this alloy.
Figure 5:
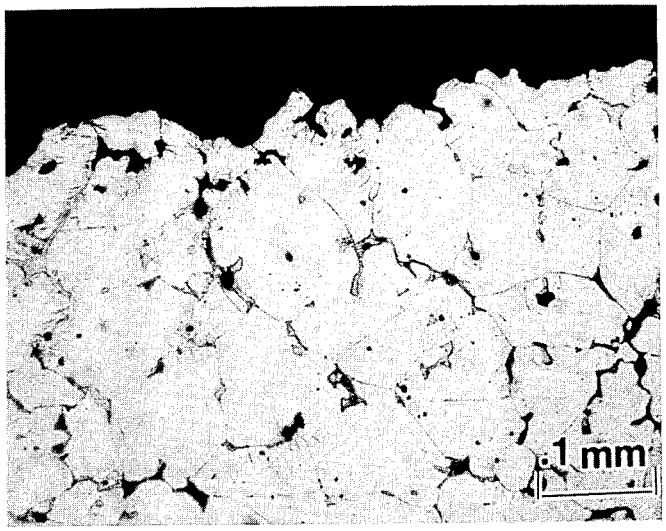
FIG. 5 is an optical micrograph of sand cast commercial magnesium alloy WE54 after immersion testing in 3.5% NaCl solution for 96 hours, illustrating poor pitting corrosion resistance of this alloy.
Figure 6:
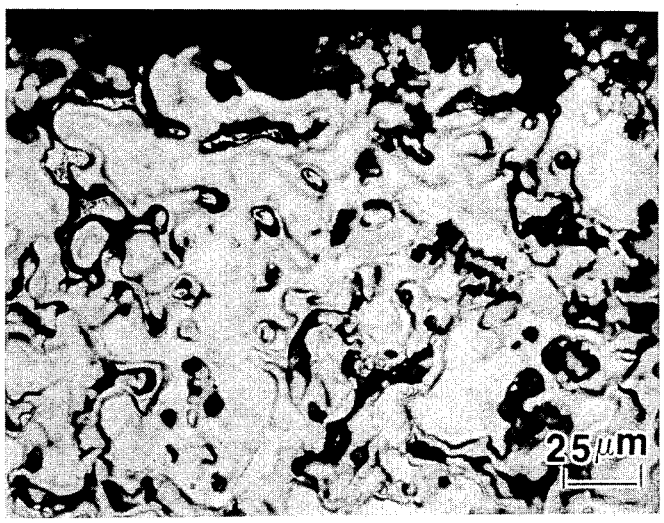
FIG. 6 is an optical micrograph of chill cast $Mg_{89.1}Al_{7.8}Zn_{2.2}Nd_{0.9}$ alloy after immersion testing in 3.5% NaCl solution for 96 hours, illustrating corrosion attack on the matrix instead of second phase particles.

Optical microstructure shows that pitting corrosion of the alloy of present invention is less severe than that of either of the commercial alloys, FIGS. 4 and 5. The second phase particles present in the alloy of the present invention are less susceptible to corrosion attack, FIG. 6.

EXAMPLE 2

A laboratory salt spray (fog) testing using a solution of 5% sodium chloride in distilled water atomized at 35° C. in the PH ranges of 6.5 to 7.2 was conducted to compare the corrosion resistance of magnesium alloys relative to each other. The test conducted was the same as that recommended by ASTM standard B-117. The apparatus consisted of a fog chamber, a salt solution reservoir, a supply of suitably conditioned compressed air, one atomizing nozzle, specimen supports, provision for heating the chamber, and means of control. Samples were cut to a size of about 5.0 cm×5.0 cm×0.5 cm, polished on a 600 grit sand paper and degreased by rinsing in acetone. The mass of the sample was weighted to an accuracy of 0.0001 g. The dimensions of each sample were measured to 0.01 cm and the total surface area of each specimen was calculated.

After 20 days exposure, the specimens were taken out, rinsed with water and dried. The corrosion product was removed by sequentially dipping the specimens in 200 gm/liter $CrO_3$ and 5 gm/liter $AgNO_3$, for 2 minutes at 80±5° C., and rinsing the specimen in distilled water. Acetone was used to degrease the specimen before weight measurement. The mass loss due to exposure was calculated.

Table II compares the % weight loss for the alloys of present invention with two commercial alloys AZ91HP and WE54. The corrosion resistance of sand and chill cast Mg-Al-Zn-Nd (Y) alloys is superior to commercial magnesium casting alloys. Addition of aluminum to the Mg-Al-Zn-Nd alloy tends to improve the corrosion resistance of the alloy.

TABLE II

Room Temperature Corrosion Behavior of Sand and Chill Cast Mg—Al—Zn—X Alloys (5% Salt Fog Exposed at 35° C. for 20 days)

| No. | Nominal Composition (At. %) | Cast | % Weight Loss |
|---|---|---|---|
| 1 | $Mg_{87.9}Al_{7.1}Zn_{1.8}Y_{3.2}$ | sand | 2.2 |
| 2 | $Mg_{90}Al_{6.5}Zn_{2.1}Nd_{1.4}$ | sand | 2.9 |
| 3 | $Mg_{91.9}Al_{5.1}Zn_{2.0}Nd_{1.0}$ | chill | 6.3 |
| 4 | $Mg_{89.1}Al_{7.8}Zn_{2.2}Nd_{0.9}$ | chill | 1.6 |
| | Alloys Outside the Scope of the Invention | | |
| | Commercial Alloy AZ91HP | | |
| 5 | $Mg_{91.7}Al_{8.0}Zn_{0.2}Mn_{0.1}$ | sand | 25.0 |
| | Commercial Alloy WE54 (Wt. %) | | |
| 6 | $Mg_{89.2}Nd_{1.7}Y_{5.2}RE_{3.5}Zr_{0.4}$ | sand | 24.2 |

EXAMPLE 3

Figure 7:
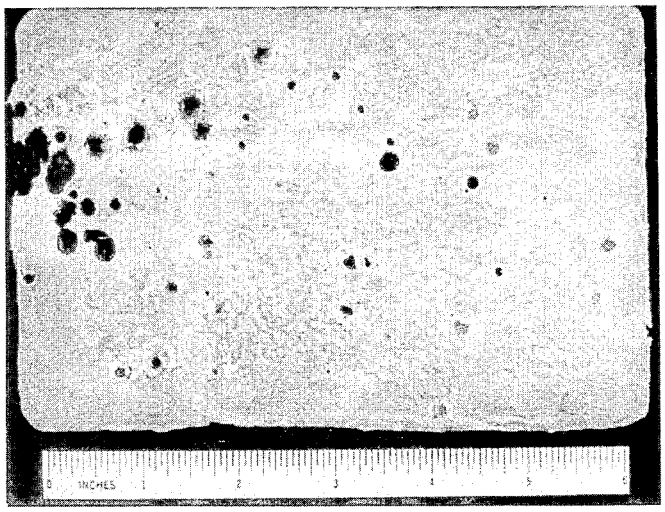
FIG. 7 is an optical micrograph of a sand cast magnesium alloy article.
Figure 8:
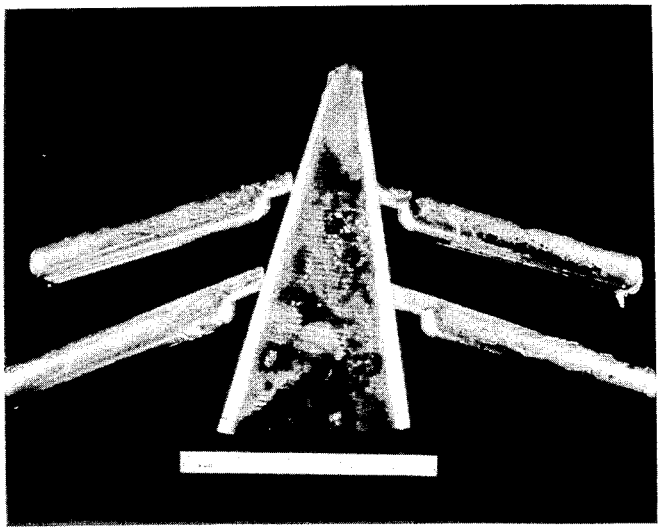
FIG. 8 is an optical marograph of a chill cast magnesium alloy article.

Mg-Al-Zn-X (X=Nd, Y, Mn, Pr, Ce) alloys were cast into sand and copper molds. The $CO_2$/silicate sand molds produced 4 plates approximately 6 inches long by 4 inches wide by ¼ inches thick, FIG. 7. The copper chill mold produced 6-1 inch diameter by 6 inches long fingers, FIG. 8. The compositions and room temperature tensile properties of sand and chill cast Mg-Al-Zn-Nd (Y) alloys are shown in Table III.

TABLE III

Chemical Analyses and Room Temperature Tensile Properties of Sand and Chill Cast Mg—Al—Zn—Nd (Y) Alloys

| | Cast | Composition (AT. %) Mg | Al | Zn | Nd | Mn | Y | RE* | Zr | 0.2% Y.S. (ksi) | UTS (ksi) | El. (%) |
|---|---|---|---|---|---|---|---|---|---|---|---|---|
| 1 | sand | 87.9 | 7.1 | 1.8 | — | — | 3.2 | — | — | 11.6 | 24.6 | 5.7 |
| 2 | chill | 91.4 | 5.1 | 1.9 | — | — | 1.6 | — | — | 20.6 | 30.6 | 3.7 |
| 3 | sand | 90.0 | 6.5 | 2.1 | 1.4 | — | — | — | — | 11.8 | 20.1 | 3.0 |
| 4 | chill | 91.9 | 5.1 | 2.0 | 1.0 | — | — | — | — | 20.7 | 36.8 | 7.0 |
| 5 | chill | 89.1 | 7.8 | 2.2 | 0.9 | — | — | — | — | 24.0 | 33.4 | 2.9 |
| 6 | chill | 91.3 | 5.0 | 2.0 | 1.7 | — | — | — | — | 22.7 | 34.2 | 4.1 |
| | | Alloys Outside the Scope of the Invention | | | | | | | | | | |
| Commercial Alloy AZ 91 C-HP | | | | | | | | | | | | |
| 7 | sand | 91.7 | 8.0 | .2 | — | .1 | — | — | — | 16.9 | 24.2 | 2.7 |
| commercial Alloy WE54 | | | | | | | | | | | | |
| 8 | chill | 89.2 | — | — | 1.7 | — | 5.2 | 3.5 | 0.4 | 23.9 | 30.8 | 2.6 |

RE*—Tb, Er, Dy and Gd

In general, chill cast Mg-Al-Zn-Nd (Y) alloys have higher yield strength than sand cast alloys. The improvement of yield strength is due to the grain refinement and uniform chemistry obtained in the chill castings. Addition of Al or Nd to Mg-Al-Zn-Nd alloys tends to increase the yield strength and decrease the ductility of the alloys. Yield strength comparable to those of commercially available high strength casting alloy, e.g. WE54 and AZ91, has been achieved in alloys 5 and 6.

EXAMPLE 4

Figure 9:
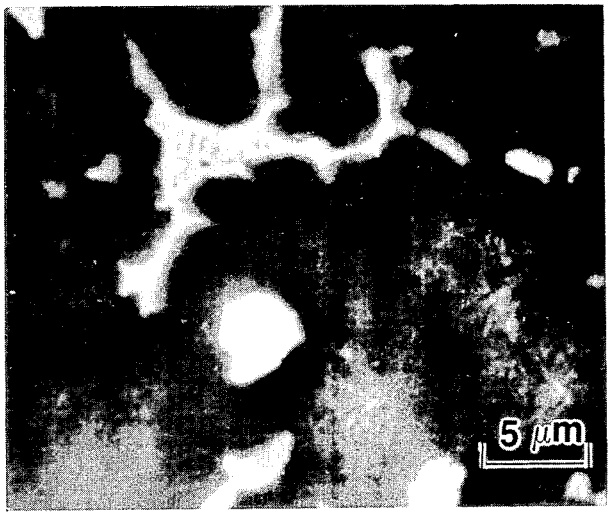
FIG. 9 is a scanning electron micrograph of chill cast $Mg_{91.9}Al_{5.1}Zn_2Nd_1$ alloy in the fully heat treated (T6) condition.

Tensile specimens of sand and chill cast Mg-Al-Zn-X alloys with compositions shown in Example 3 were subjected to solution and aging treatment to develop maximum strength. Because of the presence of Mg-Al-Zn eutectic structure, the heat treatment condition for Mg-Al-Zn-Nd (Y) alloys is quite different from that of the AZ alloys. The eutectic structure's incipient melting point of 350° C., as determined by differential thermal analysis (DTA), limits the solution treatment temperature to 300° C. Table IV shows the room temperature tensile properties of heat treated Mg-Al-Zn-Nd (Y) alloys along with their heat treatment condition. The improvement of yield strength in Mg-Al-Zn-Nd (Y) alloys is due to the refinement of Mg-Al-Zn phase on the grain boundary after aging, FIG. 9.

TABLE IV

Room Temperature Tensile Properties of Sand and Chill Cast Mg—Al—Zn—Nd (Y) Alloys After T4 and T6 Treatment

| Sample | Cast | Heat Treatment | 0.2% Y.S. (ksi) | UTS (ksi) | El. (%) |
|---|---|---|---|---|---|
| 1-T4 | sand | (300° C., 0.5 h) | 12.6 | 28.2 | 6.5 |
| 1-T6 | sand | (300° C., 0.5 h) (150° C., 21 h) | 17.3 | 28.3 | 7.4 |
| 2-T4 | chill | (300° C., 0.5 h) | 17.9 | 30.9 | 5.2 |
| 2-T6 | chill | (300° C., 0.5 h) (150° C., 16 h) | 19.0 | 34.1 | 6.7 |
| 3-T4 | sand | (300° C., 0.5 h) | 13.4 | 25.9 | 4.7 |
| 3-T6 | sand | (300° C., 0.5 h) (150° C., 22 h) | 16.1 | 29.9 | 5.5 |
| 4-T4 | chill | (300° C., 0.5 h) | 20.8 | 37.2 | 7.2 |
| 4-T6 | chill | (300° C., 0.5 h) (150° C., 16 h) | 24.3 | 39.4 | 7.5 |
| | | Alloys Outside the Scope of the Invention | | | |
| Commercial Alloy AZ91C-HP | | | | | |
| 7-T6 | sand | (410° C., 8 h) (168° C., 16 h) | 21 | 40 | 6 |
| Commercial Alloy WE54 | | | | | |
| 8-T4 | chill | (525° C., 8 h) | 23.5 | 33.1 | 4.4 |
| 8-T6 | chill | (525° C., 8 h) (250° C., 16 h) | 30.6 | 40.4 | 2.8 |

What is claimed is:

1. A magnesium casting alloy consisting of the formula $Mg_{bal}Al_aZn_bX_c$, wherein X is at least one element selected from the group consisting of neodymium, praseodymium, and yttrium, "a" ranges from about 5 to 15 atom percent, "b" ranges from about 0.2 to 4 atom percent, "c" ranges from about 0.5 to 3 atom percent, the balance being magnesium and incidental impurities, with the proviso that the sum of aluminum and zinc present ranges from about 5 to 15 atom percent.

2. An alloy as recited in claim 1 wherein said alloy has good castability and is suitable for sand, chill and permanent mold casting.

3. An alloy as recited in claim 1 wherein said alloy, when immersed in a 3.5% NaCl aqueous solution at 25° C. for 96 hours, has a corrosion rate of less than 50 mils per year.

4. An alloy as recited in claim 1 wherein said alloy, when exposed in a 5% NaCl aqueous solution atomized at 35° C. (salt fog testing) for 20 days, has a weight loss of less than 10%.

5. An article cast from the alloy as recited in claim 1 wherein said article is composed of magnesium solid solution phase containing a magnesium-aluminum-zinc eutectic structure, intermetallic phase precipitates formed between aluminum and at least one element selected from the group consisting of neodymium, praseodymium and yttrium.

6. An article cast from the alloy recited in claim 1, wherein said article is a gearbox housing, and said article has good corrosion resistance, light weight and good strength.

* * * * *